US007030312B2

(12) United States Patent
Bruti et al.

(10) Patent No.: US 7,030,312 B2
(45) Date of Patent: Apr. 18, 2006

(54) SYSTEM AND METHODS FOR CHANGING A MUSICAL PERFORMANCE

(75) Inventors: Luigi Bruti, Pedaso (IT); Andrea Celani, Ascoli Peceno (IT); Massimiliano Fattori, Ascoli Peceno (IT)

(73) Assignee: Roland Europe S.p.A., Acquaviva Picena (IT)

( * ) Notice: Subject to any disclaimer, the term of this patent is extended or adjusted under 35 U.S.C. 154(b) by 231 days.

(21) Appl. No.: 10/456,158

(22) Filed: Jun. 5, 2003

(65) Prior Publication Data

US 2004/0237758 A1 Dec. 2, 2004

(51) Int. Cl.
*G10H 7/00* (2006.01)

(52) U.S. Cl. ..... 84/645

(58) Field of Classification Search ..... 84/645
See application file for complete search history.

(56) References Cited

U.S. PATENT DOCUMENTS 5,119,711 A * 6/1992 Bell et al. ..... 84/622
6,184,454 B1 * 2/2001 Imai et al. ..... 84/622
6,600,098 B1 * 7/2003 Mizuno et al. ..... 84/622

FOREIGN PATENT DOCUMENTS

JP 09-244654 9/1997

* cited by examiner

*Primary Examiner*—Jeffrey W Donels
(74) *Attorney, Agent, or Firm*—Foley & Lardner LLP

(57) ABSTRACT

MIDI data representing a musical performance may be altered to substitute one instrument for another, change the parameters applicable to individual instruments, and change the genre of a piece by collectively implementing predetermined changes of instruments and instrument parameters. The changes may be made in an automated real time fashion so that desired changes can be implemented during performance.

53 Claims, 11 Drawing Sheets

Tones

| | Instruments | Channel | Note Min | Note Max |
|---|---|---|---|---|
| ✓ | E. Piano 2 (0,1,8) | 1 | 53 | 89 |
| ✓ | Fingered Bs. (0,1,34) | 2 | 27 | 63 |
| ✓ | Muted Gt. (0,1,29) | 3 | 46 | 70 |
| ✓ | Halo Pad (0,1,95) | 4 | 55 | 82 |
| ✓ | Chiffer Lead (0,1,84) | 4 | 67 | 82 |
| ✓ | Atmosphere (0,1,100) | 4 | 56 | 72 |
| ✓ | SynCalliope (0,1,93) | 4 | 68 | 84 |
| ✓ | Strings (0,1,49) | 5 | 43 | 96 |
| ✓ | SlowStrings (0,1,50) | 6 | 46 | 96 |
| ✓ | Harmonica (0,1,23) | 7 | 60 | 82 |
| ✓ | French Horn (0,1,61) | 8 | 58 | 70 |
| ✓ | Vibraphone (0,1,12) | 9 | 51 | 82 |
| ✓ | | 10 | 35 | 69 |
| ✓ | Ride Cymbal (Sta) [051-->051] | 10 | 51 | 51 |
| ✓ | Ride Cymbal (Sta) [059-->059] | 10 | 59 | 59 |
| ✓ | Pedal HiHat 2 (Sta) [044-->044] | 10 | 44 | 44 |
| ✓ | Close HiHat 2 (Sta) [042-->042] | 10 | 42 | 42 |
| ✓ | Side Stick (Sta) [037-->037] | 10 | 37 | 37 |
| ✓ | Open HiHat 2 (Sta) [046-->046] | 10 | 46 | 46 |
| ✓ | 65st BsDrum 1 (Sta) [035-->035] | 10 | 35 | 35 |
| ✓ | Cabasa (Sta) [069-->069] | 10 | 69 | 69 |
| ✓ | 85st Snare 2 (Sta) [038-->038] | 10 | 38 | 38 |
| ✓ | Real Tom 4 (Sta) [047-->047] | 10 | 47 | 47 |
| ✓ | Real Tom 6 (Sta) [043-->043] | 10 | 43 | 43 |
| ✓ | Crash Cym. 1 (Sta) [049-->049] | 10 | 49 | 49 |
| ✓ | Crash Cym. 2 (Sta) [057-->057] | 10 | 57 | 57 |
| ✓ | Fantasia (0,1,89) | 11 | 75 | 94 |
| ✓ | | 12 | 49 | 57 |
| ✓ | Crash Cym. 2 (Pop) [057-->057] | 12 | 57 | 57 |
| ✓ | Crash Cym. 1 (Pop) [049-->049] | 12 | 49 | 49 |
| ✓ | Harmonica (0,1,23) | 13 | 60 | 82 |

FIG. 9

SYSTEM AND METHODS FOR CHANGING A MUSICAL PERFORMANCE

RELATED APPLICATIONS

This application claims priority under 35 USC § 119(a) from Italian patent application No. B02002A00361, filed 7 Jun. 2002, the entirety of which is incorporated herein by reference.

BACKGROUND OF THE INVENTION

1. Field of the Invention

Embodiments of the present invention relate to digital music systems, and in particular to processing of data that represents a musical performance.

2. Related Technology

The MIDI (Musical Instrument Digital Interface) standard defines parameters of hardware and software for the digital representation and performance of music. MIDI systems are generally comprised of a sequencer that generates MIDI data and an electronic instrument (e.g. a synthesizer) that produces sound in accordance with MIDI data received from the sequencer. MIDI data is typically formatted in accordance with the SMF (Standard MIDI Format) format. SMF data is comprised of individual messages, each of which specifies an event that occurs during a musical performance. The electronic instrument reproduces each of those events to reproduce the performance.

Modern MIDI-compatible electronic instruments are generally multi-timbral, meaning that they are composed of multiple sub-modules that are capable of independently and simultaneously producing sounds in response to corresponding streams of MIDI messages. Each sub-module of the electronic instrument is generally referred to as a channel. Each MIDI message includes addressing information that indicates the channel of the instrument to which the message is directed.

The events represented by MIDI messages are generally classified as being either note events or non-note events. Note events are related to the generation of specific musical notes or sounds by a channel, such as initiating or terminating the sounding of a particular note, or specifying other note-specific parameters such as how hard the note is to be struck. Non-note events are generally events that are not note-specific, such as selecting the type of instrument to be used by the channel (also referred to herein as a new instrument event), or setting the volume, pan or reverb of the channel. In the case where drum sounds are to be produced, a type of drum set may be selected as the instrument for the channel, and individual notes of the channel correspond to individual elements of the selected drum set.

FIG. 2 provides an example of events that may be represented in SMF data for a musical performance. FIG. 2 shows four channels of a standard 16-channel MIDI system. In the illustrated musical performance, the MIDI messages for performing the piece is supplied to channels 3 and 10. Channel 3 is used for performing the parts of several different tonal instruments, including a piano, guitar and trumpet. Each note played by each instrument involves note events such as turning on and turning off the note, each of which is represented by a separate MIDI message. Non-note events occurring on channel 3 include a change in volume and activation of each new instrument. For the drum part performed by channel 10 there are note events corresponding to the sounding of each element of the drum set.

MIDI technology makes the performance of musical pieces relatively easy since all that is needed is the MIDI messages representing the piece and appropriate devices to reproduce the events of the piece represented by the MIDI messages. However, because the devices reproduce the piece exactly in accordance with the representation encoded in the MIDI messages, it is difficult for a musician to impart a personal interpretation to the performance.

Some sequencers now allow musicians to alter the MIDI messages representing a musical performance in order to change some aspects of the performance. However the editing features provided by these systems are generally limited to simple channel-oriented parameter changes such as changing the channel volume. However, as illustrated in FIG. 2, it is now common for one channel to use different instruments at different points in a performance. Therefore, while it would be desirable for a composer or performer to be able to alter the parameters of a single instrument within a channel, or to substitute one instrument for another, conventional sequencers do not provide this capability. Therefore, to make such changes, the user would be required to manually create, delete and edit messages to effect the desired changes. This is extremely time consuming and precludes the possibility of making such changes in a real time performance environment.

SUMMARY OF THE INVENTION

Embodiments of the present invention are directed to systems and methods that enable the alteration of MIDI messages in a manner that is not constrained to application on a channel-wide basis. Preferred embodiments enable such alterations to be made in an automated fashion in real time so that desired changes can be made during performance. Examples of changes enabled in accordance with embodiments of the invention include substituting one instrument for another, substituting one element of a drum set for another element, changing the parameters applicable to an individual instrument, and changing the genre of a piece by collectively implementing predetermined changes of instruments and instrument parameters.

DESCRIPTION OF THE DRAWINGS

The present invention is described with reference to the accompanying drawings, in which:

FIGS. 9, 10, 11 and 13 show displays generated in accordance with a preferred embodiment.

DETAILED DESCRIPTION OF PREFERRED EMBODIMENTS

Figure 1:
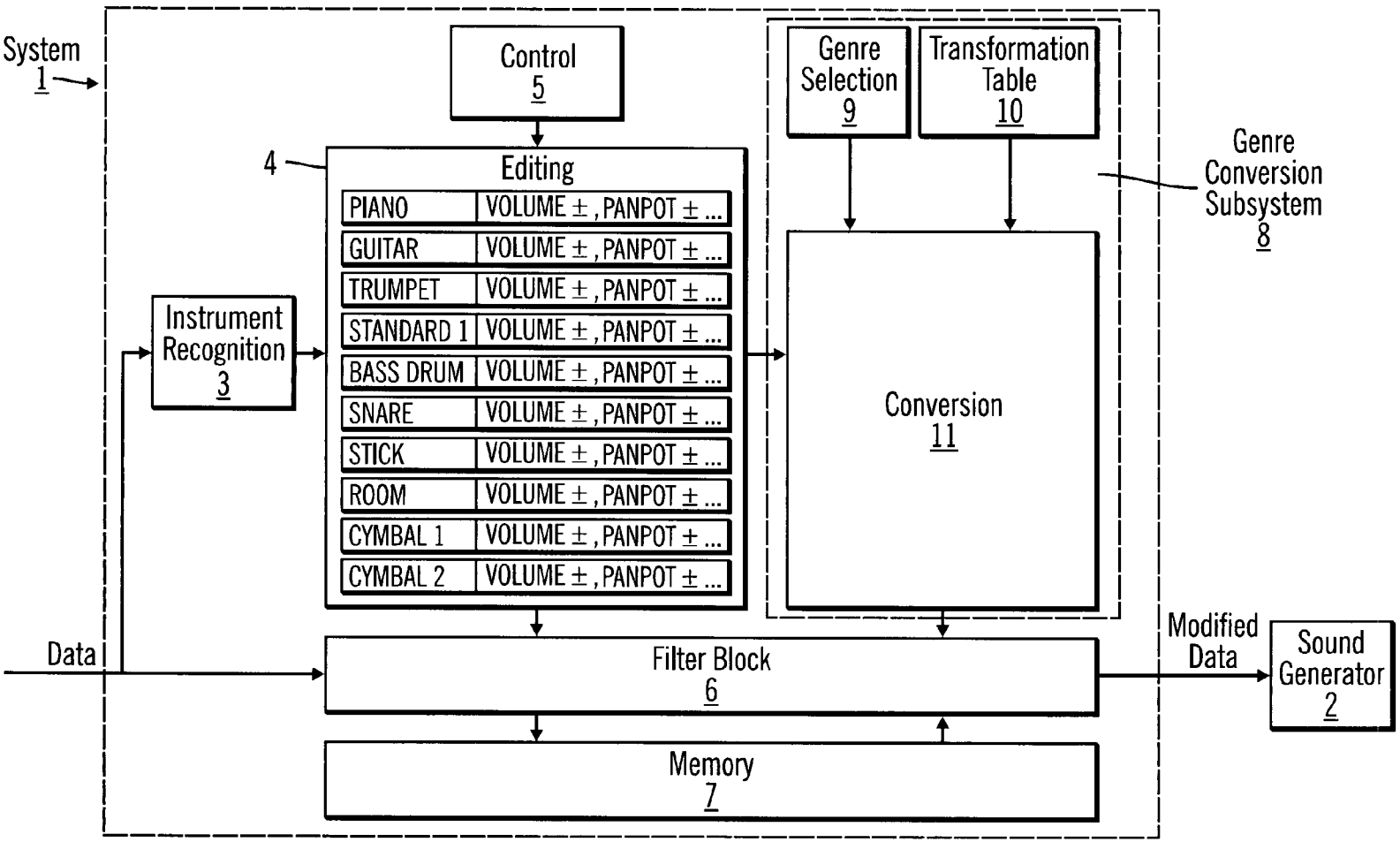
FIG. 1 illustrates a block diagram of a system for altering MIDI messages in accordance with a preferred embodiment of the present invention.
Figure 2:
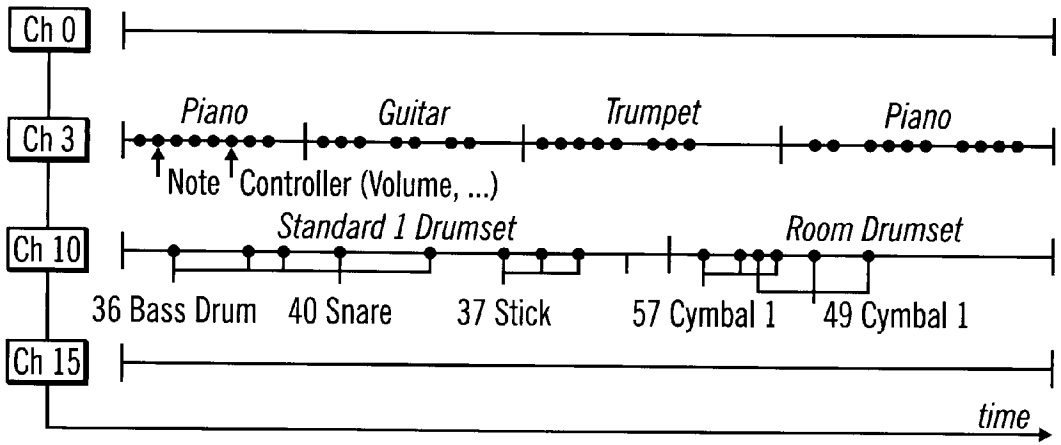
FIG. 2 illustrates of events occurring on channels of a MIDI system during a musical performance.

FIG. 1 illustrates functional components of a system in accordance with a preferred embodiment of the invention that enables a user to substitute one instrument used on a channel for another instrument and to change the parameters associated with a particular instrument on a particular channel. These changes may be made without affecting other instruments used by the same channel. The preferred embodiment of FIG. 1 further enables the user to change the genre of a musical piece by collectively implementing predetermined instrument substitutions and parameter changes associated with a genre. The changes enabled by the embodiment of FIG. 1 may be performed in an automated fashion on real time MIDI messages as the messages are being provided to an electronic instrument generate a performance. While the preferred embodiment is specific to MIDI SMF data, it will be appreciated that data formatted in accordance with other standards may be altered in an analogous manner.

The system 1 of FIG. 1 receives a MIDI message stream, processes the messages of the message stream in accordance with changes specified by the user, and outputs a modified message stream to a sound generator 2 that produces a musical performance in accordance with the modified messages. The components of the system 1 of FIG. 1 include an instrument recognition block 3 that receives the messages of a musical piece, identifies the instruments used in the piece through analysis of the individual messages, and generates a list of all of the instruments used by each channel during performance of the piece in-its original form, including all tonal instruments, all drum sets, and all drum set sub-elements. An editing block 4 displays an instrument table comprising the list of all tonal instruments, drum sets and drum set elements identified by the recognition block 3, and also displays a list of parameters that may be adjusted for each instrument in the table, such as volume, pan, reverb, chorus, octave, velocity, cutoff, resonance, and attack, as well as the values currently associated with each of those parameters.

A control block 5 of the system 1 enables a user to specify functions to be performed by the system, including substituting one instrument for another, adjusting the parameters applicable to an instrument, and turning an instrument on and off. The control block may be implemented using a keyboard, touch screen or other input device. A filter block 6 creates, deletes and alters messages in accordance with user instructions. A memory block 7 stores information concerning messages sent by the filter block 6 to the sound generator module 2, such as the types of instrument currently being used by each channel, the values of the parameters associated with each channel, and the current note event in each musical channel. The memory block 7 also stores the original parameters and other information concerning the original unmodified message stream.

Figure 3:
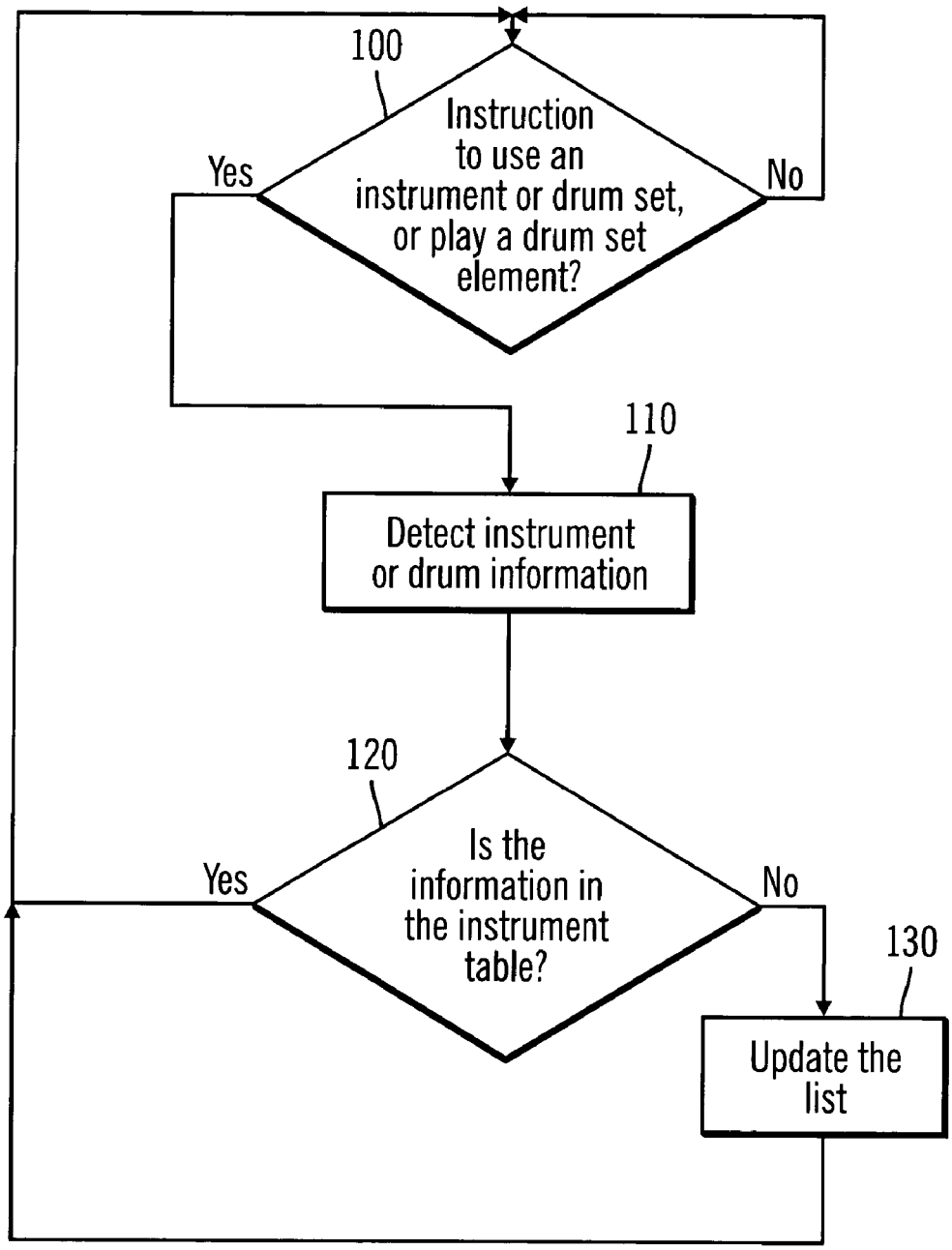
FIG. 3 illustrates processing performed by the system of FIG. 1 for generating an instrument table for a musical piece.

FIG. 3 shows processing carried out by the instrument recognition block 3 on messages of the received message stream to provide the list of the musical instruments, drum sets and drum set elements of the original piece. For each message, the instrument recognition block 3 determines (100) whether the message instructs a channel to use a tonal instrument or a drum set, or to play an element of a drum set. If the determination is negative because the message does not activate a tonal instrument or a drum set or play an element of a drum set, the instrument recognition block 3 waits for a new message upon which to perform the same analysis. On the other hand, if the determination is positive, the instrument recognition block 3 determines event information including the channel in which the detected event occurs and the specific instrument, drum set or drum set element of the event (110). Once the instrument, drum set or drum set element and its corresponding channel have been determined, it is determined whether the detected instrument, drum set or drum set element is present in the list from which the instrument table is generated (120). If the detected information is not currently represented in the list, the list is updated (130) with information representing the detected instrument, drum set or drum set element and its channel. Processing continues for each new message of the message stream.

Figure 4:
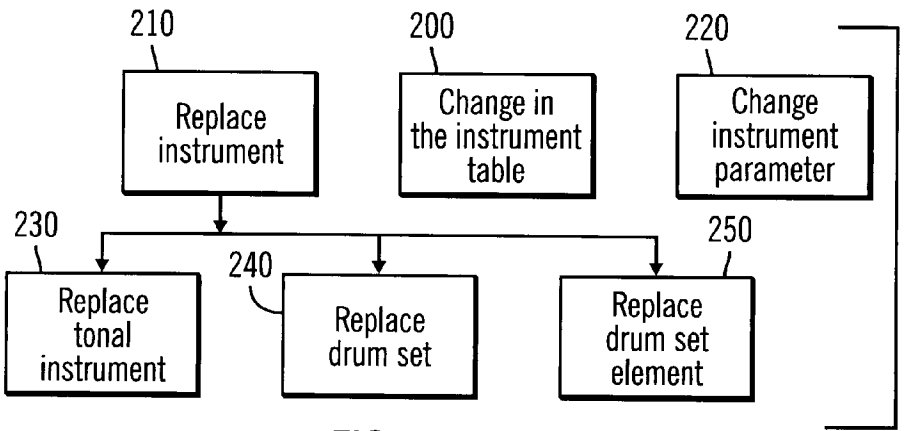
FIG. 4 illustrates types of operations that may be performed by the system of FIG. 1.

FIG. 4 shows operations that may be performed by the system of FIG. 1. In response to a command entered by a user in the form of a change to the instrument table (200), the filter block may replace one instrument with another instrument (210) and/or change the parameters (220) of an instrument. The replacement of an instrument (210) may be one of replacing a tonal instrument with another tonal instrument (230), replacing a drum set with another drum set (240), and replacing an element of a drum set with another element of the drum set (250).

Figure 5:
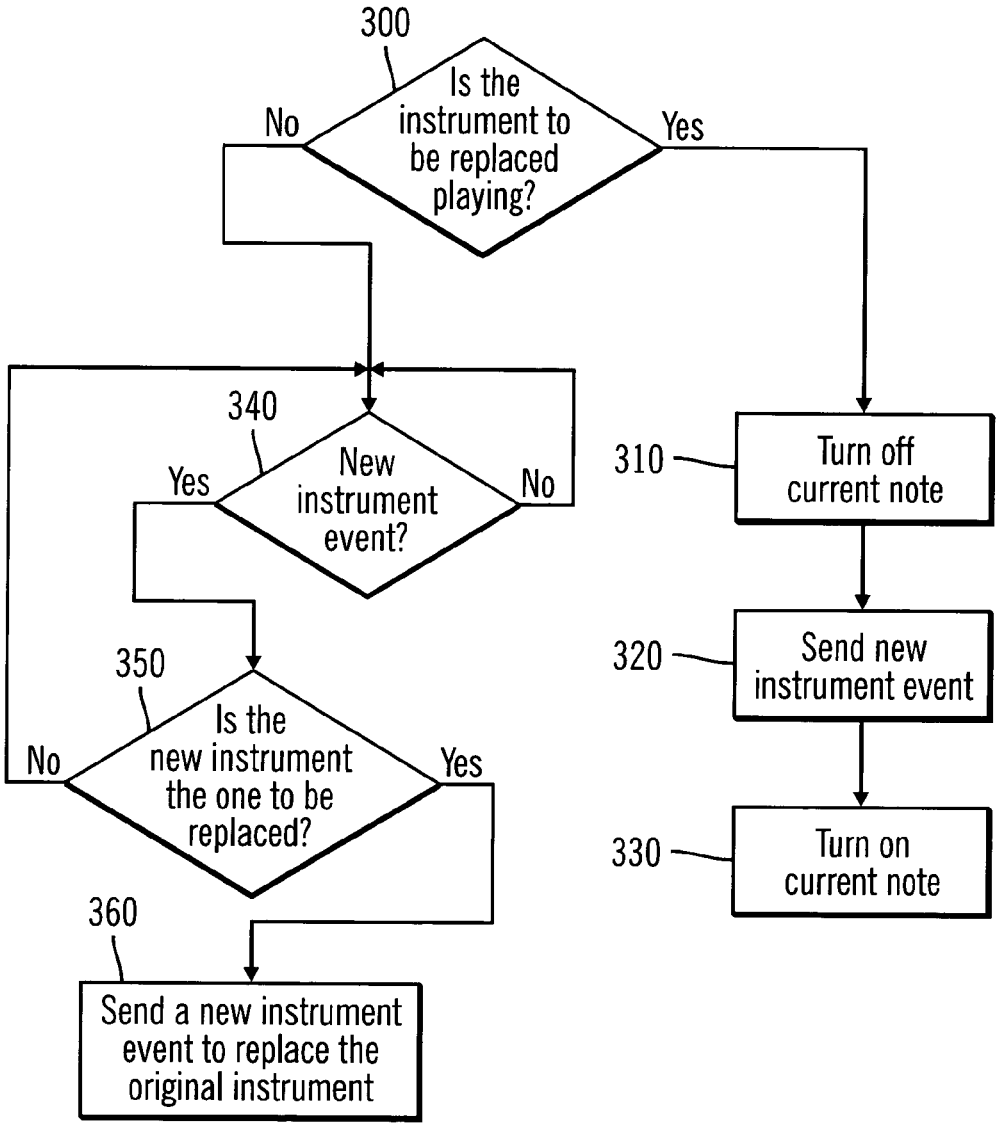
FIG. 5 illustrates processing performed by the system of FIG. 1 for replacing one instrument with another.

FIG. 5 shows processing performed by the filter block 6 when a tonal instrument is replaced with another tonal instrument during performance of the piece. For purposes of illustrating this processing, it is assumed that the user wishes to replace a piano in a given channel with a guitar. The user initiates this change by changing the piano to a guitar in the instrument table. Data indicating that the original instrument is a piano is stored by the system. As shown in FIG. 5, the filter block 6 uses instrument information stored in the memory block 7 that indicates the tonal instrument that is currently playing in the channel specified by the user command to determine (300) whether that instrument is the instrument to be replaced (i.e. the piano). If so, the filter block 6 sends a message to turn off (310) the current note in the corresponding channel of the sound generator module 2, and then sends a message containing a new instrument event to change the instrument of that channel to a guitar (320). A message to turn on current note for the channel is then sent (330), resulting in generation of that note and subsequent notes using a guitar sound rather than a piano sound.

On the other hand, if the musical instrument being used by the specified channel is not the instrument to be replaced, the filter block 6 waits for a message containing a new instrument event (340), and when a new instrument event is detected, it is determined (350) whether that new instrument event activates the instrument to be replaced (a piano) on the specified channel. If the determination is negative, the next new instrument event is awaited. If the determination is positive, the detected new instrument event is replaced with a different new instrument event (360) that changes the original instrument to the one that is to replace it.

Where changes of instruments are specified prior to performance of the piece, it is preferred that the processing of FIG. 5 is performed on the real time message stream that generates the performance. While the processing of FIG. 5 describes replacement of a single instrument, analogous processing may be used to replace multiple instruments in accordance with multiple user commands. A variation on the processing of FIG. 5 may be used to eliminate instruments by turning off the current instrument without replacing it with a new instrument.

Figure 6:
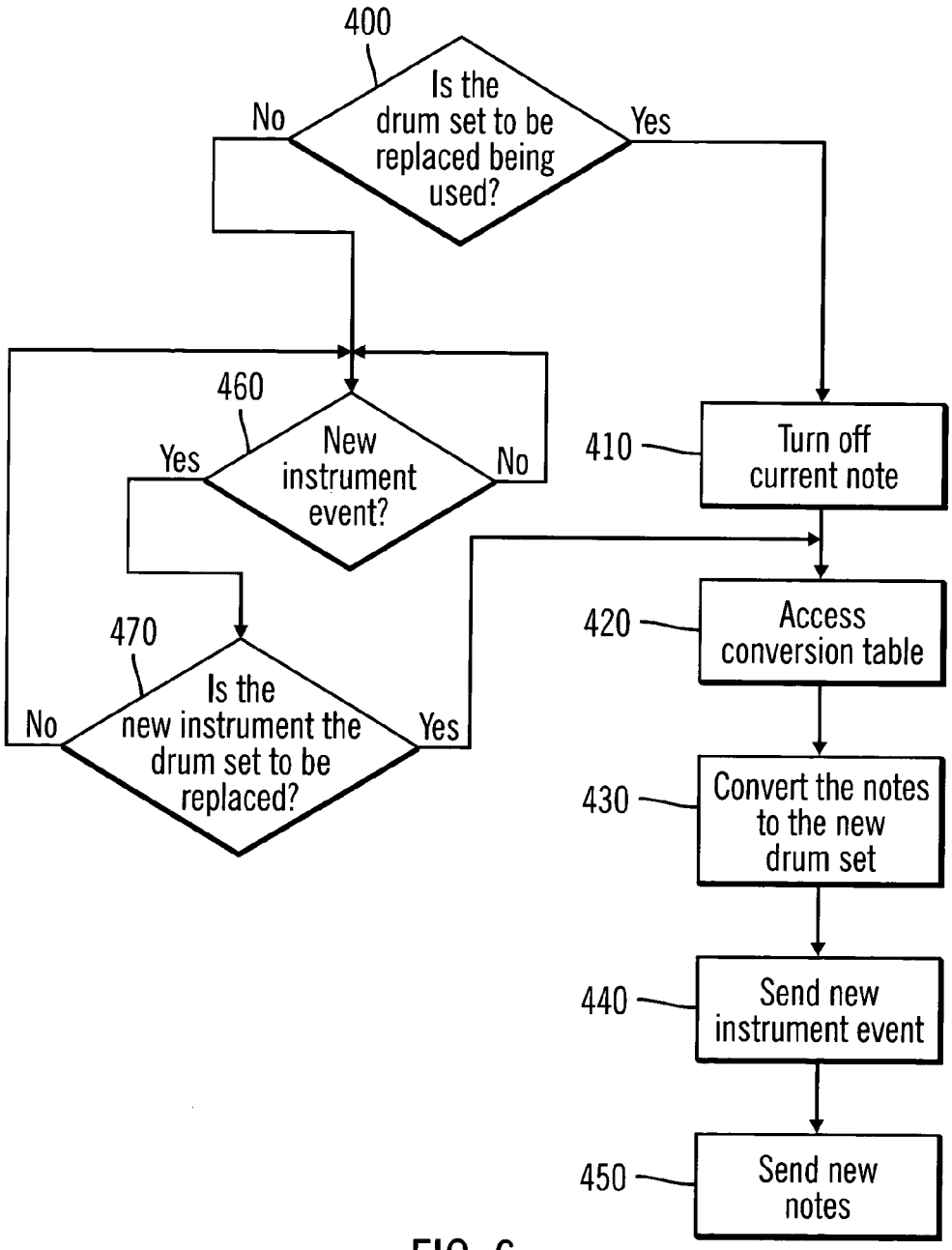
FIG. 6 illustrates processing performed by the system of FIG. 1 for replacing one drum set with another.

FIG. 6 shows processing performed by the system to replace one drum set with another. For purposes of illustrating this processing, it will be assumed that the processing is performed to replace a classic drum set on a given channel with an ethnic drum set. This processing in initiated by a user by changing the type of drum set listed in the instrument table. Upon making this change, data indicating the original drum set is stored by the system. As shown in FIG. 6, the filter block 6 initially determines from the memory 7 whether the drum set to be replaced is currently being used on the channel for which the change is specified (400). If so, the filter block (410) sends a message to turn off the current note in that channel. The filter block then accesses a conversion table (420) that associates the elements (notes) of the original drum set with elements (notes) of the new drum set, and converts (430) the notes for the original drum set to corresponding notes for the new drum set. A new instrument event is then sent (440) to instruct the channel to begin using the new drum set, and messages containing the new note numbers are then sent to the channel (450). As a result, the performance of the piece continues with the new drum set replacing the original drum set.

On the other hand, if the drum set being used by the specified channel is not the drum set that is to be replaced, the filter block 6 waits for a message containing a new instrument event (460). When a new instrument event is detected, the filter block 6 determines whether the new instrument event activates the drum set that is to be replaced on the specified channel (470), and if so processing proceeds to conversion of notes of the original drum set to corresponding notes of the new drum set (420) and subsequent processing.

Where a change of drum sets is specified prior to performance of the piece, it is preferred that the processing of FIG. 6 is performed on the real time message stream that generates the performance. While the processing of FIG. 6 describes replacement of a single drum set, analogous processing may be used to perform multiple replacements in accordance with multiple user commands. A variation on the processing of FIG. 6 may be used to eliminate a drum set by eliminating notes for that drum set from the message stream without replacing them with new messages.

Figure 7:
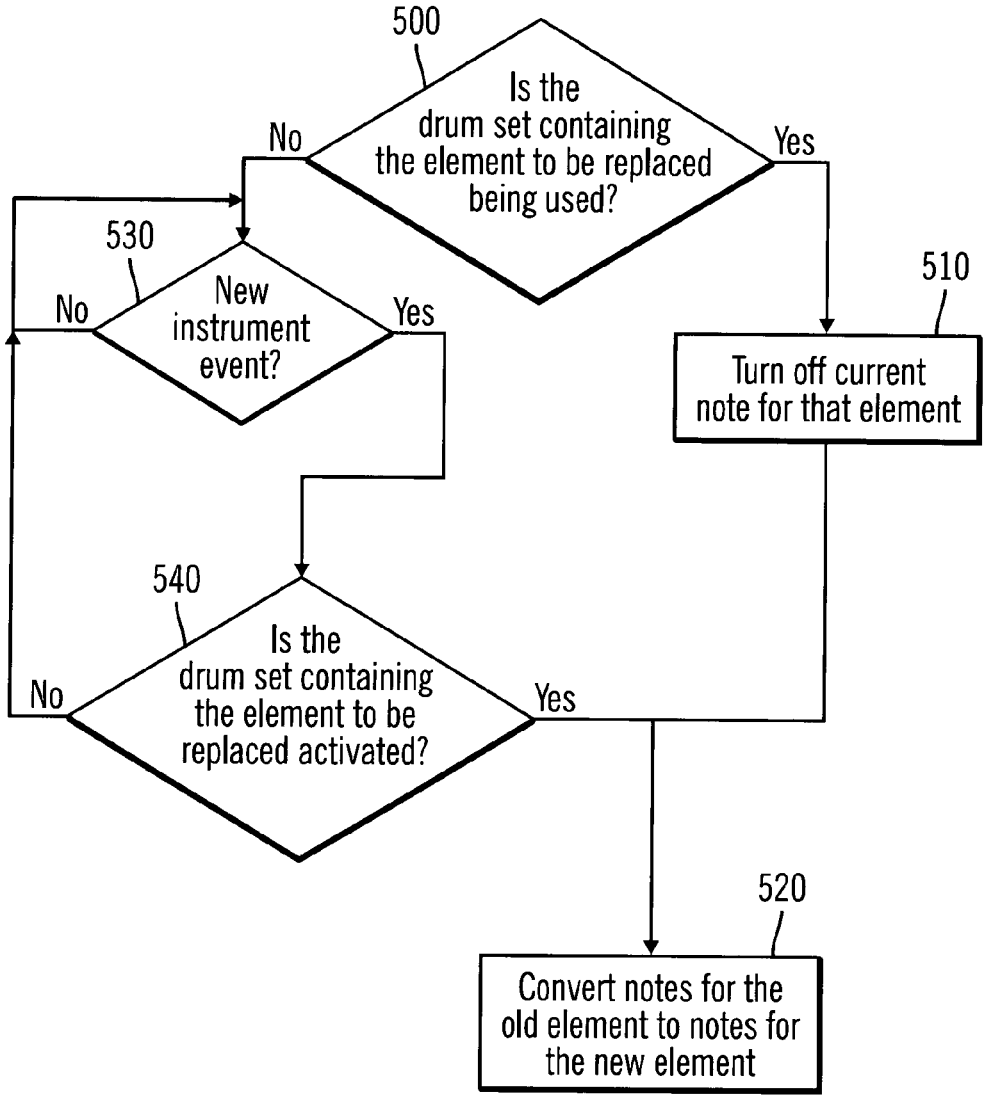
FIG. 7 illustrates processing performed by the system of FIG. 1 for replacing one element of a drum set with another.

FIG. 7 shows processing performed by the system to replace an element of a drum set with a different element of the same drum set. For purposes of illustrating this processing, it will be assumed that the processing is performed to replace a cowbell sound of the drum set with a hand clap sound of the same drum set. A user initiates this processing by changing the drum set element in the instrument table. Upon making this change, data indicating the original drum set element is stored by the system. As shown in FIG. 7, the filter block 6 uses information stored in the memory block 7 to determine whether the drum set that includes the element (i.e. the cowbell) to be replaced is currently being used by the specified channel (500). If so, the filter block 6 sends a message to turn off (510) the current note. The filter block 6 then converts (520) notes associated with the element to be replaced (i.e. every cowbell note) into notes for the element that is to replace it (i.e. hand clap notes), and sends those new notes to the sound generator module 2.

On the other hand, if the drum set currently being used by the specified channel is different from the drum set for which the element is to be replaced, the filter block 6 waits for a message containing a new instrument event (530). When a new instrument event occurs, the filter block 6 determines whether the new instrument event activates the drum set containing the element to be replaced on the specified channel (540). If so, processing proceeds to conversion of notes (520).

Where a change of drum set elements is specified prior to performance of the piece, it is preferred that the processing of FIG. 7 is performed on the real time message stream from which the performance is generated. While the processing of FIG. 7 describes replacement of a single drum set element, analogous processing may be used to replace multiple drum set elements in accordance with multiple user commands. A variation on the processing of FIG. 7 may be used to eliminate a drum set element by eliminating notes for that drum set element from the message stream without replacing them with new messages. A further alternative to the processing of FIG. 7 may replace a single element of a drum set with a single element of another drum set. Such processing requires the sending of a new instrument event before and after each note using the new drum set element, so that the channel is effectively switched temporarily to the drum set of that drum set element every time that element is to be played. This substitution requires significant processing power and may therefore be undesirable in some applications.

Figure 8:
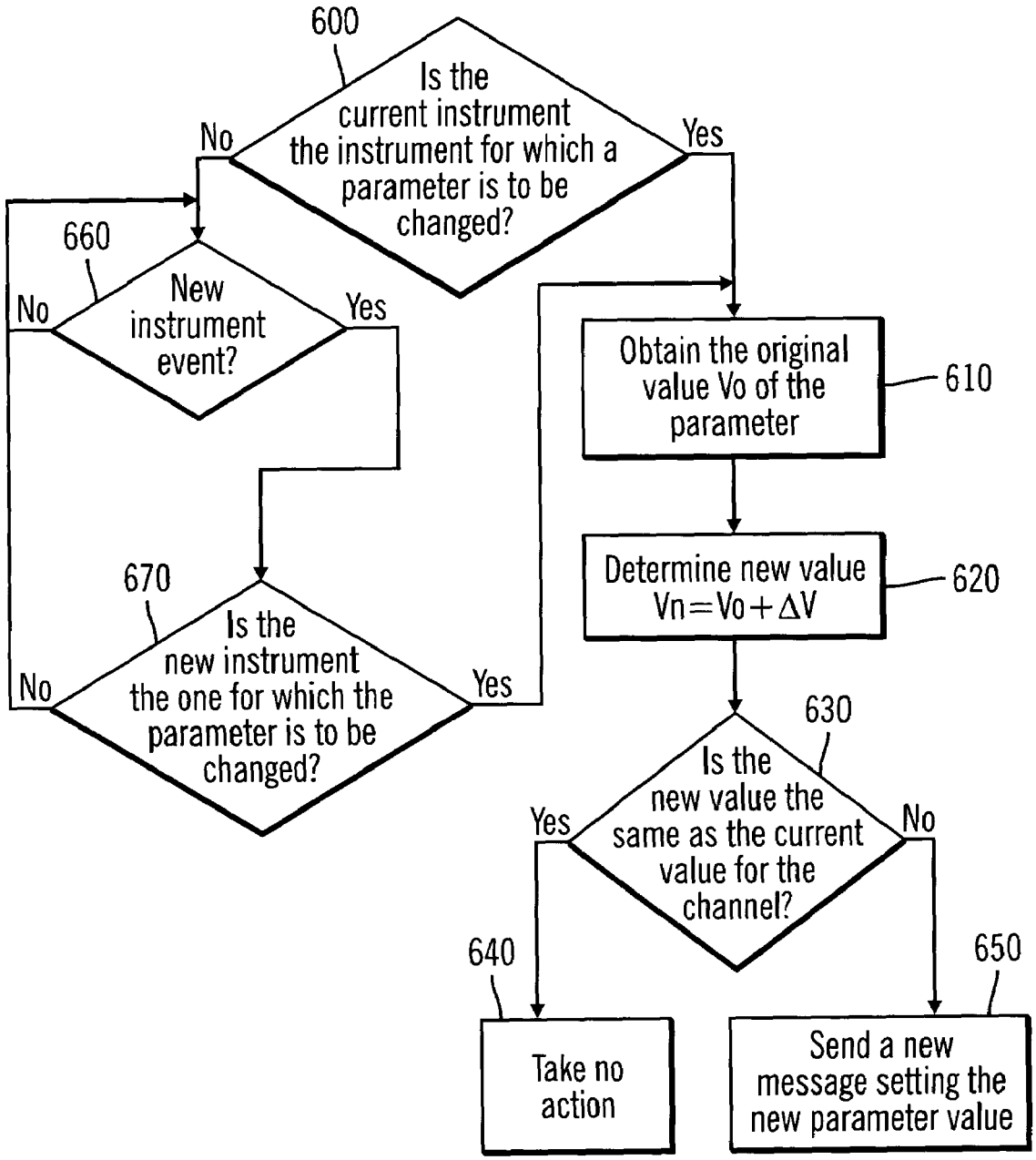
FIG. 8 illustrates processing performed by the system of FIG. 1 for changing a parameter of an instrument.

FIG. 8 shows processing performed by the system to adjust a parameter of a specified instrument on a specified channel in real time during performance of a piece. It is noted that each parameter represented in the instrument table has an initial reference value, i.e. the value assigned in the original message stream, and that adjustments to parameters may be represented as a difference with respect to the initial value. For purposes of illustrating the processing of FIG. 8, it will be assumed that the processing is performed to change the volume of a piano used by the third channel. A volume change can be either positive or negative and will be represented by the symbol $\Delta V$. The volume change amount is indicated by commands received from the user and stored in the instrument table of the editing block 4. In the processing of FIG. 8, the filter block 6 uses information stored in the memory block 7 to determine whether the instrument currently used by the specified channel is the instrument for which the parameter is to be changed (600). If so, the original value for the parameter (i.e. the value for that parameter specified in the original message received by the system) is obtained from the memory block 7 (610). That value will be referred to hereinafter as $V_O$. The filter block then determines a new value of the parameter $V_N$ as the sum of $V_O$ and $\Delta V$ (620). It is then determined whether the current value for that parameter in the specified channel is the same as the new value (630). If so, the filter block takes no action (640). If not, the filter block 6 sends a message to the sound generator module 2 setting the new value for the parameter in the specified channel (650).

On the other hand, if the instrument currently being used by the channel is not the instrument for which the parameter is to be changed, the filter block 6 waits for a message containing a new instrument event (660). When a new instrument event is detected the filter block 6 determines whether the new instrument is the instrument for which the parameter is to be changed and is used by the specified channel (670). If so, processing proceeds to obtaining the original value of the parameter (610) and subsequent processing.

While the processing of FIG. 8 is illustrated by a change of one parameter of one instrument, analogous processing may be employed to change the same parameter for all instruments, or to change multiple parameters of one or more instruments. Where a parameter change is specified before performance of a piece, it is preferred that the processing of FIG. 8 is performed on the real time message stream from which the performance is generated.

Returning to the system diagram of FIG. 1, the preferred embodiment further comprises a subsystem 8 enabling the user to convert the musical genre of a piece to a different musical genre. In general terms, the genre of a given piece is significantly dependent on the ensemble of instruments that is used to perform the piece, as well as the parameters associated with each of those instruments. The subsystem 8 of FIG. 1 enables the user to replace the instruments that are specified in the original message stream with instruments that are characteristic of a specified musical genre. As shown in FIG. 1, the subsystem 8 comprises a selection block 9 that generates a display representing user selectable musical genres, such as pop, rock, and dance. The subsystem 8 further includes a memory block 10 that stores transformation tables. The transformation tables include tables indicating the instrument substitutions to be used for each given genre, and tables specifying the parameters of each instrument for each given genre.

The sub-system 8 further comprises a conversion block 11 that generates an instrument table listing the tonal instruments, drum sets and drum set elements for playing a given piece in accordance with a given genre, as well as the parameters applicable to each of those instruments, drum sets and elements in accordance with the given genre. The conversion block 11 further performs genre conversion by obtaining the original instrument list for a piece from the editing block 4, determining the tonal instruments, drum sets and drum set elements of the selected genre that correspond to those of the original piece, and assigning parameter values to each new tonal instrument, drum set and drum set element in accordance with the selected genre using the tables stored in the subsystem memory block 10. The changes determined by the conversion block 11 are implemented by the filter block 6 and are preferably implemented on the real time message stream from which the performance is generated. In particular, to perform genre conversion, the filter block performs the processing of FIG. 5 for changing tonal instruments, performs the processing of FIG. 6 for changing drum sets, performs the processing of FIG. 7 for changing drum set elements, and performs the processing of FIG. 8 for changing instrument parameters. This enables the user to generate a performance in accordance with any musical genre for which appropriate tables are provided in the genre subsystem 8.

Figure 12:
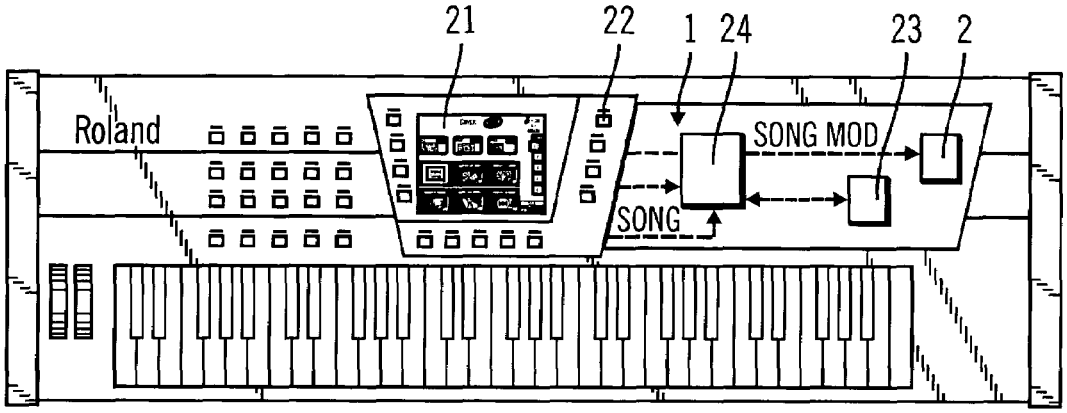
FIG. 12 illustrates an implementation of the preferred embodiment in an electronic keyboard.

The system of FIG. 1 may be embodied in a variety of forms. As a general matter, the system of FIG. 1 is embodied in a programmable device that includes a computer readable medium such as a RAM, ROM, cd-rom, hard disk, etc., storing programming instructions for performing the processing and implementing the functionalities described above. Such a device may be a personal computer or other computing device. In a preferred embodiment the system of FIG. 1 is implemented in a device such as an electronic keyboard that includes both a sequencer for generating MIDI messages and a sound generator for performing the piece in accordance with the MIDI messages. FIG. 12 shows a preferred implementation of the system of FIG. 1 in an electronic keyboard 20. The keyboard includes a display device 21 that displays information such as the instrument table or the musical genres that can be selected by the user. The electronic keyboard 20 is further provided with a control device 22 enabling the user to change genres, instruments and parameters. The electronic keyboard further includes a memory 23 that is used for implementing the storage represented by blocks 7 and 10 of the system of FIG. 1, and a central processing unit 24 for performing the processing and providing the functionalities described above.

Figure 10:
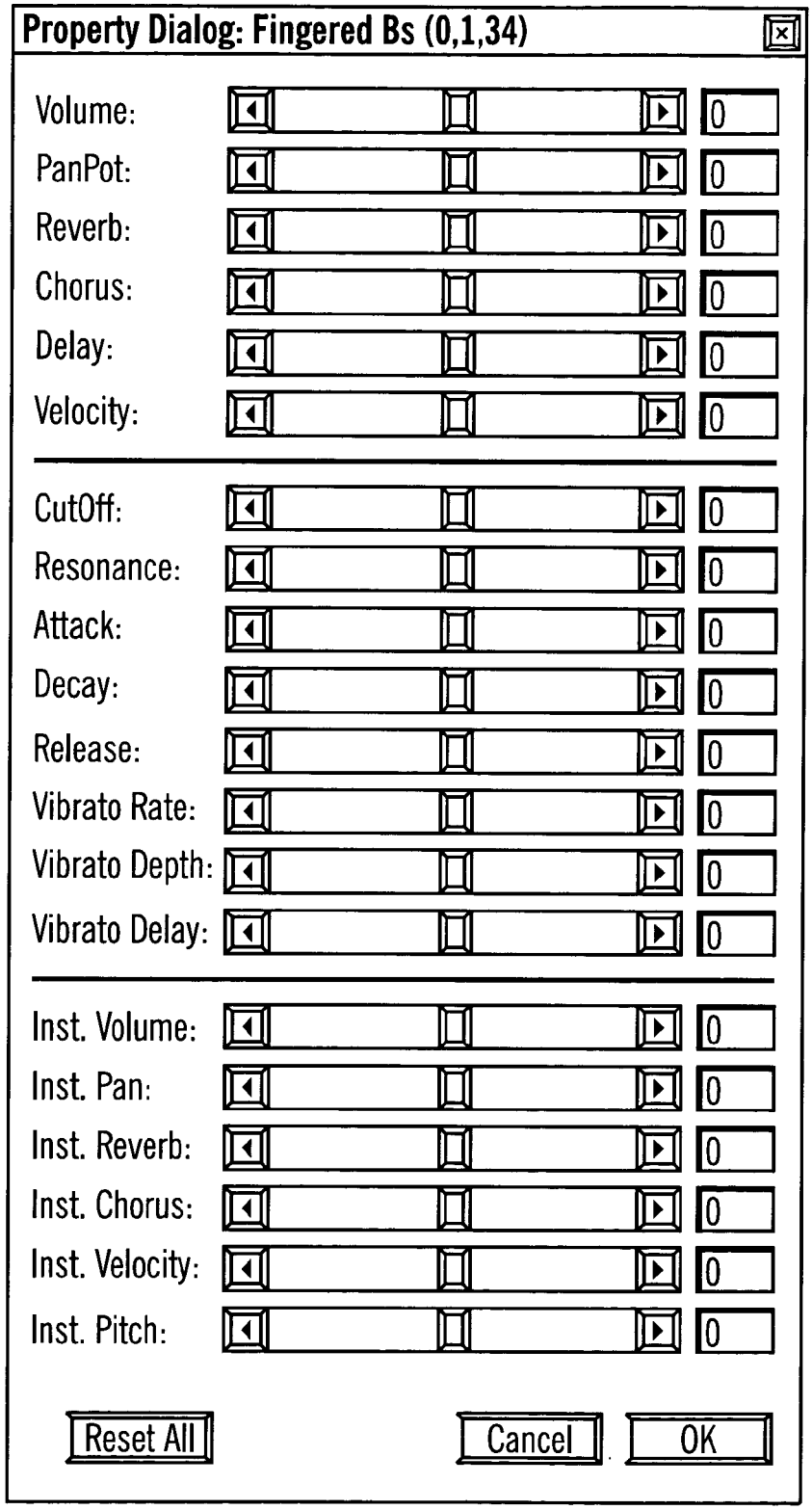
Figure 11:
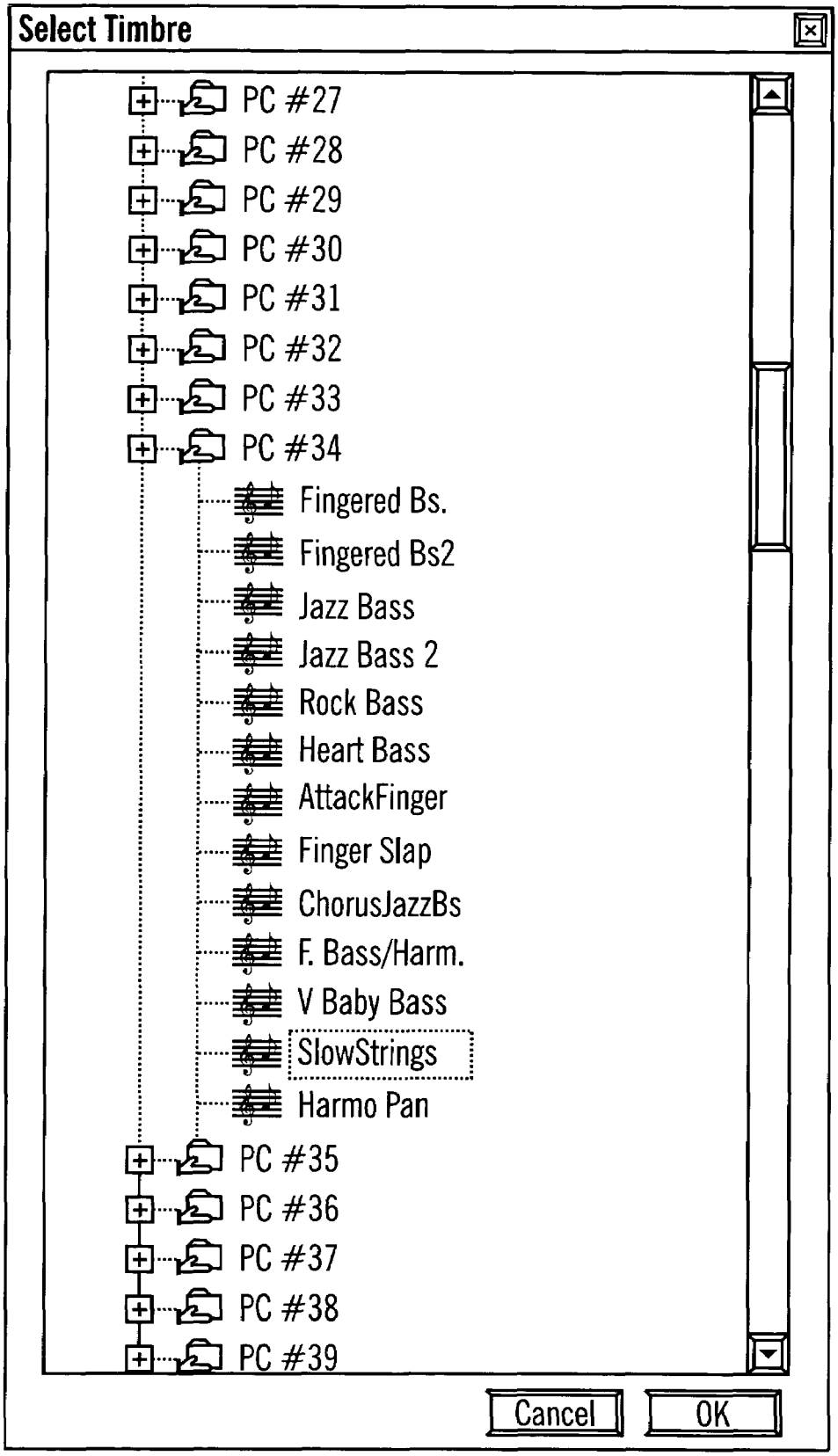

FIGS. 9, 10 and 11 show examples of displays provided by the display device 21 of the preferred embodiment that enable the user to utilize the processing and functionalities described above. FIG. 9 illustrates a window displaying an instrument table for a musical performance, including the instruments detected by the recognition block 3 and their corresponding channels. Referring to this display, the user is enabled to turn on or off every instrument in the instrument table or replace any instrument in the table with another available instrument. A list of available instruments as illustrated in FIG. 11 may be displayed to assist the user in making the selection. Further, from the window of FIG. 9, the user may access a further window as illustrated in FIG. 10 that displays the parameters associated with a selected instrument and enables the user to adjust those parameters.

Figure 13:
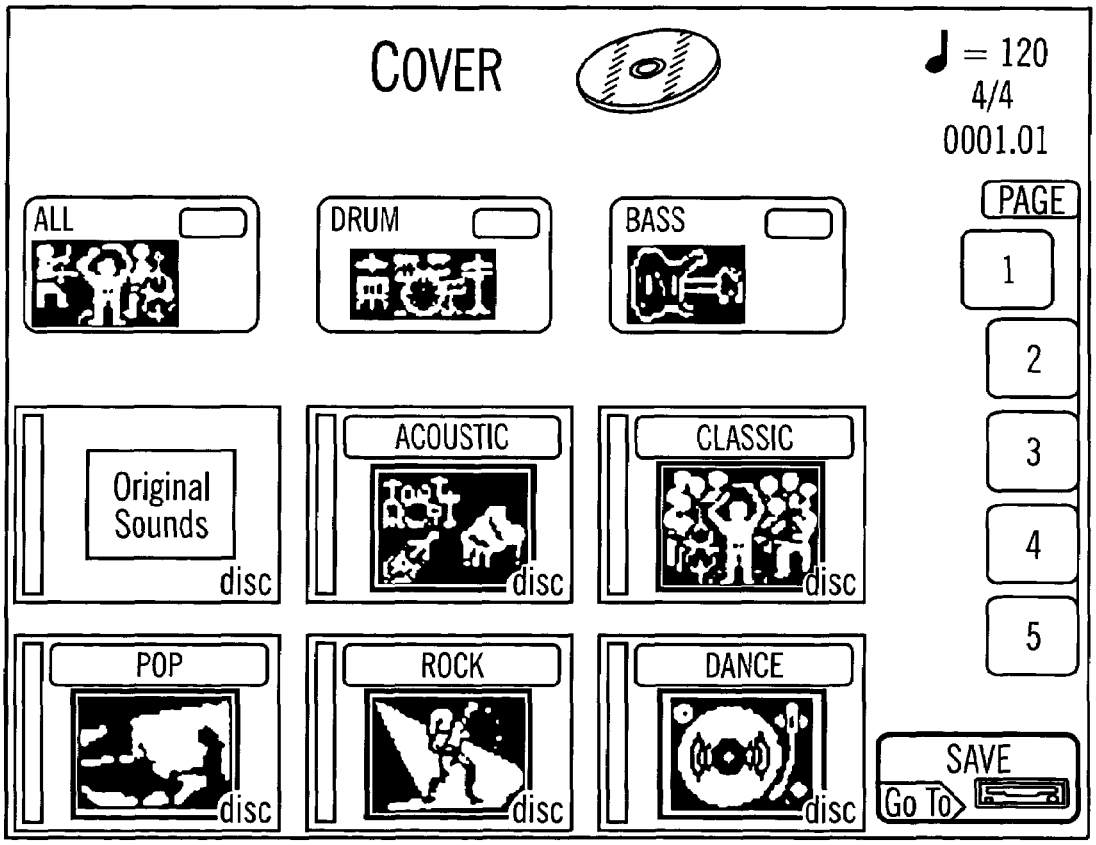

FIG. 13 illustrates a window used for selecting a musical genre. In the preferred embodiment as illustrated in FIG. 13, this window enables the user to change from one musical genre to another, and to apply this change to all of the instruments used in the performance, or to just the drum or the bass instruments.

While the preferred embodiment of the invention performs message creation, deletion and modification in real time during performance of a piece in response to user commands, in alternative embodiments user commands may be executed to generate a new set of MIDI messages representing a modified performance without sending the messages to a sound generator. Further, while the preferred embodiment of the invention is implemented in an electronic keyboard, it will be appreciated that the invention may also be implemented in a variety of other devices, such as in other electronic instruments, in stand-alone sequencers, and in computers running musical composition or performance applications.

The preferred embodiment provides a number of advantages. A user is enabled to modify the characteristics of a performance simply and quickly. The parameters of individual instruments may be changed, instruments may be substituted by other instruments, drum sets may be changed, individual drum set elements may be changed, and the entire genre of a piece may be changed collectively by implementing predetermined changes of instruments and instrument parameters.

It will be apparent to those having ordinary skill in the art that the features and processing described above are not necessarily exclusive of other features or processing, but rather that further features and processing may be incorporated in accordance with a particular implementation. Thus, while the embodiments illustrated in the figures and described above are presently preferred, it should be understood that these embodiments are offered by way of example only. The invention is not limited to a particular embodiment, but extends to various modifications, combinations, and permutations that fall within the scope of the claimed inventions and their equivalents.

What is claimed is:

1. A system for changing data representing a musical performance, the data comprising a plurality of temporally distributed messages wherein each message represents an event that occurs during said musical performance, the system comprising:

instrument recognition means for processing the messages representing the musical performance to provide a list of instruments activated on each channel of a sound generator during said musical performance; and changing means for selectively changing a feature of said musical performance specific to an instrument used by one of said channels by changing messages representing the musical performance.

2. A system for changing data representing a musical performance, the data comprising a plurality of temporally distributed messages wherein each message represents an event that occurs during said musical performance, the system comprising:

instrument recognition means for processing the messages representing the musical performance to provide a list of instruments activated on each channel of a sound generator during said musical performance; and changing means for selectively changing a feature of said musical performance specific to an instrument used by one of said channels by changing messages representing the musical performance;

wherein said changing means comprises:

display means for displaying said instrument list and parameters associated with each instrument in said instrument list;

control means for receiving a user command specifying one of replacing a tonal instrument with another tonal instrument, replacing a drum set with another drum set, and replacing a drum set element with another drum set element; and filter means for implementing a received user command through one or more of adding, deleting and modifying messages representing said musical performance.

3. A programmable device for processing data representing a musical performance, the device comprising a computer readable medium storing instructions that, when read, cause the device to perform the method steps of:

determining instruments to be used by each channel of a sound generator during the musical performance from messages representing events of the musical performance;

receiving a user command to change a feature of the musical performance relating to a specified instrument used by a specified channel, independent of changing a feature relating to another instrument; and modifying the messages representing the events of the musical performance to implement the change specified in the user command.

4. A programmable device for processing data representing a musical performance, the device comprising a computer readable medium storing instructions that, when read, cause the device to perform the method steps of:

determining instruments to be used by each channel of a sound generator during the musical performance from messages representing events of the musical performance;

receiving a user command to change a feature of the performance relating to a specified instrument used by a specified channel; and modifying the messages representing the events of the musical performance to implement the change specified in the user command;

wherein determining instruments comprises determining tonal instruments used in the performance, determining drum sets used in the performance, and determining drum set elements used in the performance.

5. The device claimed in claim 3, wherein the user command comprises a command to substitute a new tonal instrument on a specified channel for an existing tonal instrument on the specified channel, and wherein modifying the messages comprises producing a message instructing the specified channel to use the new tonal instrument.

6. The device claimed in claim 5, wherein modifying the messages further comprises substituting said message instructing the specified channel to use the new tonal instrument for a message instructing the specified channel to use the existing tonal instrument.

7. A programmable device for processing data representing a musical performance, the device comprising a computer readable medium storing instructions that, when read, cause the device to perform the method steps of:

determining instruments to be used by each channel of a sound generator during the musical performance from messages representing events of the musical performance;

receiving a user command to change a feature of the performance relating to a specified instrument used by a specified channel; and modifying the messages representing the events of the musical performance to implement the change specified in the user command;

wherein the user command comprises a command to substitute a new tonal instrument on a specified channel for an existing tonal instrument on the specified channel, wherein modifying the messages comprises producing a message instructing the specified channel to use the new tonal instrument, and wherein modifying the messages further comprises providing the message instructing the specified channel to use the new tonal instrument to the specified channel upon detecting that the specified channel is using the existing tonal instrument.

8. A programmable device for processing data representing a musical performance, the device comprising a computer readable medium storing instructions that, when read, cause the device to perform the method steps of:

determining instruments to be used by each channel of a sound generator during the musical performance from messages representing events of the musical performance;

receiving a user command to change a feature of the performance relating to a specified instrument used by a specified channel; and modifying the messages representing the events of the musical performance to implement the change specified in the user command;

wherein the user command comprises a command to substitute a new drum set on a specified channel for an existing drum set on the specified channel, and wherein modifying the messages comprises producing a message instructing the specified channel to use the new drum set.

9. The device claimed in claim 8, wherein modifying the messages further comprises substituting said message instructing the specified channel to use the new drum set for a message instructing the specified channel to use the existing drum set.

10. The device claimed in claim 8, wherein modifying the messages comprises providing said message instructing the specified channel to use the new drum set to the specified channel upon detecting that the specified channel is using the existing drum set.

11. The device claimed in claim 8, wherein determining instruments and their associated channels specified in messages representing events of a musical performance comprises determining elements of the existing drum set used in the musical performance; and wherein modifying the messages comprises substituting messages instructing the specified channel to play elements of the new drum set for messages instructing the specified channel to play corresponding elements of the existing drum set.

12. A programmable device for processing data representing a musical performance, the device comprising a computer readable medium storing instructions that, when read, cause the device to perform the method steps of:

determining instruments to be used by each channel of a sound generator during the musical performance from messages representing events of the musical performance;

receiving a user command to change a feature of the performance relating to a specified instrument used by a specified channel; and modifying the messages representing the events of the musical performance to implement the change specified in the user command;

wherein determining instruments and their associated channels specified in messages representing events of a musical performance comprises determining elements of a drum set used in the musical performance, wherein the user command comprises a command to substitute a new element of the drum set on a specified channel for an existing element of the drum set on the specified channel, and wherein modifying the messages comprises substituting messages instructing the specified channel to play the new element of the drum set for messages instructing the specified channel to play the existing element of the drum set.

13. The device claimed in claim 3, wherein the user command comprises a command to change a specified parameter of a specified instrument on a specified channel, and wherein modifying the messages comprises generating a message setting a new value for the specified parameter in the specified channel upon detecting that the specified channel is using the specified instrument.

14. The device claimed in claim 3, wherein said device is an electronic keyboard comprising a sound generator for reproducing said musical performance in accordance with said messages representing events of said musical performance.

15. A programmable device for processing data representing a musical performance, the device comprising a computer readable medium storing instructions that, when read, cause the device to perform the method steps of:

determining instruments to be used by each channel of a sound generator during the musical performance from messages representing events of the musical performance;

receiving a user command to change a feature of the performance relating to a specified instrument used by a specified channel; and modifying the messages representing the events of the musical performance to implement the change specified in the user command;

further comprising a display for displaying said instruments to be used by each channel of the sound generator.

16. The device claimed in claim 15, wherein said display further displays parameters associated with each of said instruments.

17. A programmable device for processing data representing a musical performance, the device comprising a computer readable medium storing instructions that, when read, cause the device to perform the method steps of:

determining instruments to be used by each channel of a sound generator during the musical performance from messages representing events of the musical performance;

receiving a user command to change a feature of the performance relating to a specified instrument used by a specified channel; and modifying the messages representing the events of the musical performance to implement the change specified in the user command;

wherein said modifying is performed in real time during reproduction of said musical performance by said sound generator.

18. A method for modifying a musical performance, comprising:

determining instruments to be used by each channel of a sound generator during reproduction of the musical performance by the sound generator from messages representing events of the musical performance;

receiving a user command to change a feature of the musical performance relating to a specified instrument used by a specified channel, independent of changing a feature relating to another instrument; and modifying the messages representing the events of the musical performance to implement the change specified in the user command.

19. The method claimed in claim 18, wherein modifying the messages comprises substituting a message instructing the specified channel to use a new tonal instrument for a message instructing the specified channel to use a tonal instrument to be replaced by the new tonal instrument.

20. The method claimed in claim 18, wherein modifying the messages comprises providing a message instructing the specified channel to use a new tonal instrument to the specified channel upon detecting that the specified channel is using a tonal instrument to be replaced by the new tonal instrument.

21. A method for modifying a musical performance, comprising:

determining instruments to be used by each channel of a sound generator during reproduction of the musical performance by the sound generator from messages representing events of the musical performance;

receiving a user command to change a feature of the musical performance relating to a specified instrument used by a specified channel; and modifying the messages representing the events of the musical performance to implement the change specified in the user command;

wherein modifying the messages comprises substituting a message instructing the specified channel to use a new drum set for a message instructing the specified channel to use a drum set to be replaced by the new drum set.

22. A method for modifying a musical performance, comprising:

determining instruments to be used by each channel of a sound generator during reproduction of the musical performance by the sound generator from messages representing events of the musical performance;

receiving a user command to change a feature of the musical performance relating to a specified instrument used by a specified channel; and modifying the messages representing the events of the musical performance to implement the change specified in the user command;

wherein modifying the messages comprises providing a message instructing the specified channel to use a new drum set to the specified channel upon detecting that the specified channel is using a drum set to be replaced by the new drum set.

23. The method claimed in claim 22, wherein modifying the messages further comprises substituting messages instructing the specified channel to play elements of a new drum set for messages instructing the specified channel to play corresponding elements of a drum set to be replaced by the new drum set.

24. A method for modifying a musical performance, comprising:

determining instruments to be used by each channel of a sound generator during reproduction of the musical performance by the sound generator from messages representing events of the musical performance;

receiving a user command to change a feature of the musical performance relating to a specified instrument used by a specified channel; and modifying the messages representing the events of the musical performance to implement the change specified in the user command;

wherein modifying the messages comprises substituting messages instructing the specified channel to play a new element of a drum set for messages instructing the specified channel to play an element of the drum set to be replaced by the new element.

25. A computer readable medium storing programming instructions for performing processing as recited in claim 18.

26. A programmable device for processing data representing a musical performance, the device comprising a computer readable medium storing instructions that, when read, cause the device to perform the method steps of:

determining instruments to be used by each channel of a sound generator during reproduction of the musical performance by the sound generator from messages representing events of the musical performance;

receiving a user command to change a genre of the musical performance; and modifying the messages representing the events of the musical performance in accordance with predetermined relationships among instruments to implement the genre change specified in the user command.

27. The device claimed in claim 26, wherein modifying the messages comprises:

detecting a message instructing a channel to use a tonal instrument; and substituting a message instructing the channel to use a different tonal instrument of a specified genre that corresponds to the tonal instrument of the detected message.

28. The device claimed in claim 27, wherein modifying the messages further comprises generating a message setting a parameter value of the channel associated with the different tonal instrument in accordance with the specified genre.

29. The device claimed in claim 26, wherein modifying the messages comprises:

detecting a message instructing a channel to use a drum set; and substituting a message instructing the channel to use a different drum set of a specified genre that corresponds to the drum set of the detected message.

30. The device claimed in claim 29, wherein modifying the messages further comprises generating a message setting a parameter value of the channel associated with the different drum set in accordance with the specified genre.

31. The device claimed in claim 26, wherein modifying the messages comprises:

detecting a message instructing a channel to play an element of a drum set; and substituting a message instructing the channel to play an element of a different drum set that corresponds to the element of the drum set of the detected message in accordance with the specified genre.

32. The device claimed in claim 26, wherein said modifying is applied only to drum elements of said musical performance.

33. The device claimed in claim 26, wherein said modifying is applied only to bass instruments of said musical performance.

34. The device claimed in claim 26, wherein said device is an electronic keyboard comprising a sound generator for reproducing said musical performance in accordance with said messages representing events of said musical performance.

35. The device claimed in claim 26, further comprising a display for displaying said instruments to be used by each channel of the sound generator and genres selectable by the user.

36. A method for changing the genre of a musical performance, comprising:

determining instruments to be used by each channel of a sound generator during reproduction of the musical performance by the sound generator from messages representing events of the musical performance;

receiving a user command to change a genre of the musical performance; and modifying the messages representing the events of the musical performance in accordance with predetermined relationships among instruments to implement the genre change specified in the user command.

37. The method claimed in claim 36, wherein modifying the messages comprises:

detecting a message instructing a channel to use a tonal instrument; and substituting a message instructing the channel to use a different tonal instrument of a specified genre that corresponds to the tonal instrument of the detected message.

38. The method claimed in claim 37, wherein modifying the messages further comprises generating a message setting a parameter value of the channel associated with the different tonal instrument in accordance with the specified genre.

39. The method claimed in claim 36, wherein modifying the messages comprises:

detecting a message instructing a channel to use a drum set; and substituting a message instructing the channel to use a different drum set of a specified genre that corresponds to the drum set of the detected message.

40. The method claimed in claim 39, wherein modifying the messages further comprises generating a message setting a parameter value of the channel associated with the different drum set in accordance with the specified genre.

41. The method claimed in claim 36, wherein modifying the messages comprises:

detecting a message instructing a channel to play an element of a drum set; and substituting a message instructing the channel to play an element of a different drum set that corresponds to the element of the drum set of the detected message in accordance with the specified genre.

42. The method claimed in claim 36, wherein said modifying is applied only to drum elements of said musical performance.

43. The device claimed in claim 36, wherein said modifying is applied only to bass instruments of said musical performance.

44. A computer readable medium storing programming instructions for performing processing as recited in claim 36.

45. A system as recited in claim 1, wherein the list of instruments comprises:

tonal instruments activated on each channel of a sound generator during said musical performance;

drum sets activated on each channel of a sound generator during said musical performance; and drum set elements activated on each channel of a sound generator during said musical performance.

46. A system as recited in claim 1, wherein the list of instruments is dynamically created by detecting messages instructing a specified channel to use an instrument.

47. A system as recited in claim 1, wherein each instrument in the list of instruments is associated with instrument parameters.

48. A system as recited in claim 1, wherein the system further comprises a display device for displaying the list of instruments, and wherein providing the list of instruments comprises displaying the list of instruments on the display device.

49. A system as recited in claim 1, wherein changing the feature of said musical performance is initiated by a user based on information in the list of instruments.

50. A system as recited in claim 1, wherein changing the feature of said musical performance specific to an instrument used by a specified channel is independent of changing a feature relating to another instrument.

51. A system as recited in claim 1, wherein changing the feature of said musical performance specific to an instrument used by a specified channel is independent of changing a feature relating to another instrument used by the specified channel.

52. A device claimed in claim 3, wherein changing the feature of the musical performance relating to the specified instrument used by the specified channel is independent of changing a feature relating to another instrument used by the specified channel.

53. A method claimed in claim 18, wherein changing the feature of the musical performance relating to the specified instrument used by the specified channel is independent of changing a feature relating to another instrument used by the specified channel.

* * * * *